United States Patent [19]

Evans

[11] Patent Number: 4,506,736

[45] Date of Patent: Mar. 26, 1985

[54] PRESSURE BIASED SEAL COMPRESSOR

[75] Inventor: Robert W. Evans, Huntsville, Tex.

[73] Assignee: Hughes Tool Company, Houston, Tex.

[21] Appl. No.: 479,050

[22] Filed: Mar. 25, 1983

[51] Int. Cl.[3] ..... E21B 23/06

[52] U.S. Cl. ..... 166/387; 166/129; 277/27; 277/73

[58] Field of Search ..... 277/27, 73, 76; 166/387, 120, 129, 131, 133, 141, 150, 152, 183

[56] References Cited

U.S. PATENT DOCUMENTS

| | | | |
|---|---|---|---|
| 2,893,492 | 7/1959 | Brown | 166/129 |
| 3,253,656 | 5/1966 | Brown | 166/129 |
| 3,329,210 | 7/1967 | Brown | 166/129 |
| 3,508,610 | 4/1970 | Kisling | 166/133 |
| 3,552,489 | 1/1971 | Berrymen | 166/129 |
| 3,797,572 | 3/1976 | Mignotte | 166/133 |
| 3,963,076 | 6/1976 | Winslow | 166/278 |
| 4,105,069 | 8/1978 | Baker | 166/51 |
| 4,106,779 | 8/1978 | Zabcik | 277/27 |
| 4,188,998 | 2/1980 | Upton | 166/129 |
| 4,214,629 | 7/1980 | Upton | 166/129 |
| 4,253,522 | 3/1981 | Setterberg, Jr. | 166/278 |
| 4,271,903 | 6/1981 | Slagle | 166/129 |
| 4,411,435 | 10/1983 | McStravik | 166/120 |

*Primary Examiner*—William F. Pate, III

*Attorney, Agent, or Firm*—Robert A. Felsman; Charles D. Gunter, Jr.

[57] ABSTRACT

An improved seal assembly is shown for use in an oil well packer of the type having a packer body having a longitudinal bore, a packer carried on the body for sealing off the annular space between the body and a surrounding well conduit, a mandrel slidably disposed within the body longitudinal bore, the mandrel being spaced-apart from the body to define a fluid flow path between the mandrel exterior and the interior of the body, and wherein the mandrel is slidable between an open, running-in position in which the fluid flow path communicates the annular space above the packer with the mandrel longitudinal passageway and a closed, set-position in which the fluid flow path is sealed off. The improvement comprises a face seal housing as a part of the mandrel which has a weight loading shoulder and a deformable seal portion. The weight loading shoulder is engageable with the packer body when the mandrel is in the closed, set position to thereby support the weight of the mandrel from the body. A pressure biased seal compressor is carried between the mandrel and the body for contacting the deformable seal portion when the mandrel is in the closed, set-position to seal off the fluid flow path. The weight loading shoulder supports the large compressive loads often encountered in service work without increasing the compressive stress on the deformable seal.

11 Claims, 4 Drawing Figures

PRESSURE BIASED SEAL COMPRESSOR

BACKGROUND OF THE INVENTION

The present invention relates to oil well tools of the type used to pack off the annular space between the tool and surrounding well bore and, specifically, to an improved seal compressor for controlling fluid communication from the interior of the tool to the exterior of the tool and from the regions above and below the set packer.

Well bore packers are tools which are suspended in a well bore, usually from a pipe or tubing string running to the well surface. Such devices include an expandable seal element known as a "packer" which is expanded radially outwardly to contact the surrounding well bore or a surrounding well conduit to thereby pack off a portion of the well annulus. In many such devices, the packer element is carried on a packer body which has a longitudinal bore for receiving a packer mandrel. The mandrel is slidably received within the longitudinal bore of the packer body and is spaced-apart from the body to provide a fluid flow path between the exterior of the mandrel and the interior of the packer body. By appropriate manipulation, the mandrel can be moved into contact with the packer body to seal off the fluid flow path from within the tool to the exterior of the tool and from the regions above and below the set packer. The sealed fluid flow path within the tool might then be used, for instance, to conduct pressurized fluid to a part of the tool which further anchors the tool in the well bore, or other tool operations.

One difficulty with prior designs was that the mandrel and associated pipe string often weigh thousands of pounds. If the point of contact between the mandrel and packer body was also the seal point to close off the fluid flow path, the seal was subjected to extreme compressive loading, thereby reducing seal life and leading to early seal failure. Other prior designs featured seals which were acted upon by the pressure differential which exists between the pipe string fluid pressure and the annular fluid pressure both above and below the packer seal. Such pressure differentials at times caused seal failure.

There exists a need, therefore, for a seal mechanism which is isolated from the load carrying portions of the mandrel and packer body and which is effective to seal off the fluid flow path between the mandrel and packer body regardless of the amount or direction of the pressure differential which exists across the set packer.

SUMMARY OF THE INVENTION

The present oil well packer has a packer body having a longitudinal bore extending therethrough. A packer is carried on the packer body for sealing off the annular space between the body and a surrounding well conduit. A mandrel slidably disposed within the body longitudinal bore has upper and lower connecting means for connecting the mandrel in a pipe string. The mandrel also has a longitudinal passageway extending therethrough for communicating with the pipe string at either end. The mandrel is spaced-apart from the packer body to define a fluid flow path between the exterior of the mandrel and the interior of the body. Passage means communicate the mandrel longitudinal passageway with the fluid flow path. The mandrel is slidable between an open, running-in position in which the fluid flow path communicates with the annular space above the packer and a closed, set-position in which the fluid flow path is sealed off. A face seal housing is provided as a part of the mandrel and has a weight loading shoulder and a deformable seal portion. The weight loading shoulder is engageable with the packer body when the mandrel is in the closed, set-position to thereby support the weight of the mandrel from the body. Pressure biased seal means carried between the mandrel and body contact the deformable seal portion when the mandrel is in the closed, set-position to seal off the fluid flow path.

The face seal housing preferably forms an upset area in the external diameter of the mandrel, the upset area having an upper extent and a lower extent. The lower extent of the upset area forms a circumferential weight loading shoulder engageable with the packer body and includes a circumferential recess containing the deformable seal portion.

The pressure biased seal means is a generally cylindrical seal compressor having an upper extent for contacting the deformable seal portion and a lower extent. An annular pressure chamber is formed in the packer body between the mandrel exterior and the packer body interior and the seal compressor is received within an upper portion of the pressure chamber.

A balancing piston is received within the pressure chamber below the seal compressor and is engageable with the seal compressor to urge the seal compressor toward the deformable seal portion. The balancing piston has a primary face area and a secondary face area.

The balancing piston primary face area is acted upon by fluid pressure from the mandrel longitudinal passageway communicated through the the passage means and fluid flow path. The balancing piston secondary face area is acted upon by fluid pressure from the annular space between the packer body and the surrounding well conduit communicated to the secondary face area through port means in the packer body. The seal compressor is also preferably spring-biased in the direction of the deformable seal portion. By selectively sizing the cross-sectional areas of the piston primary and secondary faces and the seal compressor upper extent, the seal compressor can be biased toward the deformable seal portion to close off the fluid flow path regardless of the direction of the pressure differential acting upon the tool.

Additional objects, features, and advantages will be apparent in the written description which follows.

DETAILED DESCRIPTION OF THE INVENTION

Figure 1:
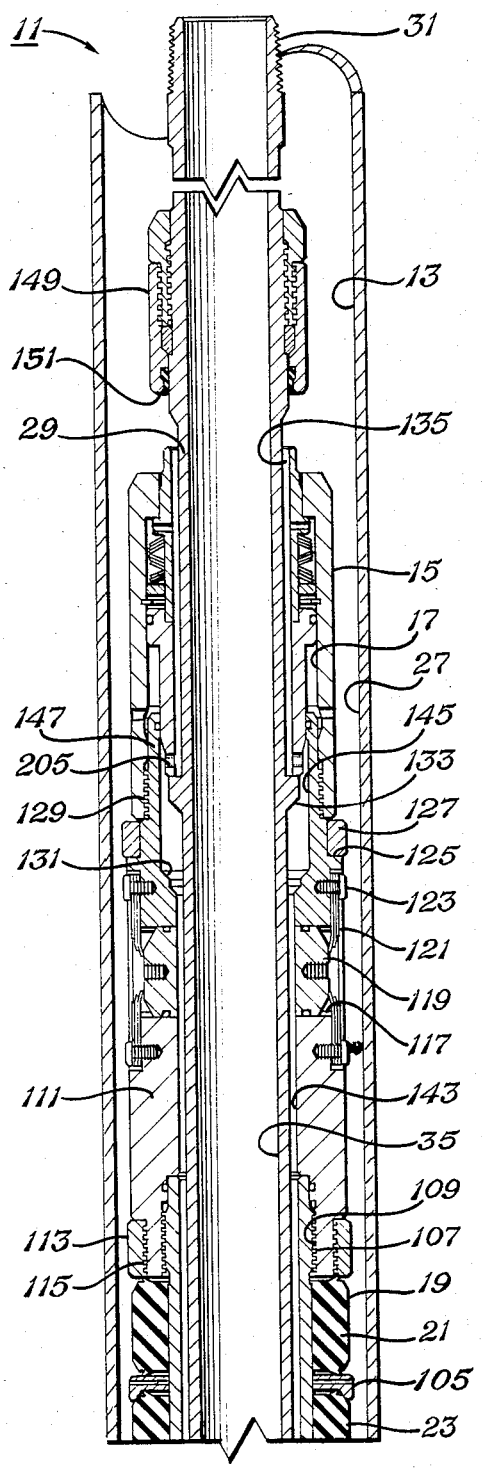
FIG. 1 is a side cross-sectional view of the upper portion of an oil well packer in a well bore which includes the improved seal means of the invention.

Turning now to FIG. 1, there is shown an improved oil well packer of the invention designated generally as 11. The packer 11 is shown in the running-in position in a well bore, in this case lined by a casing 13. The packer 11 includes a packer body 15 having a longitudinal bore 17 extending therethrough. A packer assembly 19 including deformable rubber seal elements 21, 23 and 25 is carried on the packer body 15 for sealing off the annular space 27 between the packer body 15 and the surrounding well bore or conduit 13.

A mandrel 29 is slidably disposed within the body longitudinal bore 17. The mandrel 29 has upper connecting means 31 for connecting the mandrel 29 in a pipe string (not shown) to thereby support the packer 11 from the well surface and a longitudinal passageway 35 extending therethrough for communicating with the pipe string. The packer 11 also has lower connecting means 33 for connecting the packer to a bottom sub (not shown). The mandrel will normally have an open lower end 34 to provide fluid communication between the mandrel longitudinal passageway 35 and the well annulus below the packer assembly 19.

Figure 2:
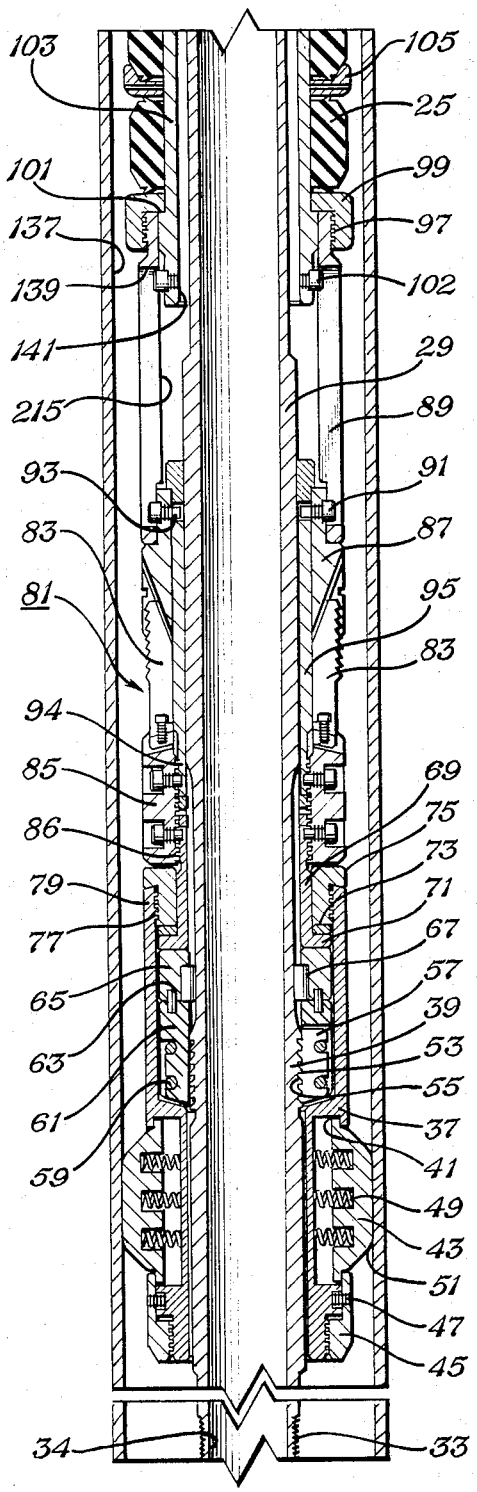
FIG. 2 is a downward continuation of the side, cross-sectional view of the packer of FIG. 1.

A drag block sub 37 is received about the lower end 39 of the mandrel 29 and includes a recess 41 for receiving conventional drag blocks 43 which are retained within recess 41 by retaining ring 45 and set screws 47. As shown in FIG. 2, drag blocks 43 are biased outwardly by means of a plurality of springs 49 so that the outer surface 51 of the drag blocks 43 makes frictional contact with the interior of the well casing 13 as the packer 11 is run into position in the well bore.

As shown in FIG. 2, the mandrel 29 includes a threaded exterior surface 53 at the lower end 39 which releasably engages mating threads 55 of a control dog 57 held by means of garter springs 59 within a control dog carrier 61. The threaded surface 53 of the mandrel 29 engages the mating threads 55 of the control dog 57 in the position shown to prevent downward sliding movement of the mandrel 29 within the packer body 15. The control dog carrier 61 is connected by means of pins 63 to an upper control member 65. A key 67 contacts the upper control member 65 as mandrel 29 is rotated within the packer body 15 to limit the rotation thereof. Control dog 57 together with control dog carrier 61 make up a 360° cylindrical internal surface with the control dog internal threads comprising approximately 90° of the circumferential area of the internal surface. By providing threaded surface 53 of mandrel 29 about approximately 270° of the circumference of the mandrel at lower end 39, the mandrel can be released from engagement with the control dog 57 by rotation from the surface.

Once the key 67 contacts the upper control member 65, the operator at the surface knows that the threads 53, 55 have disengaged, thereby allowing downward sliding movement of the mandrel 29 within the packer body 15. The drag blocks 43 provide frictional engagement with the surrounding well casing 13 to allow the rotational disengagement of the mandrel and packer body.

An inner sleeve 69 is carried about the mandrel 29 and has a lower flange 71 upon which rests a bearing 73 which in turn supports an upper ring 75. Upper ring 75 has an externallly threaded surface 77 for engaging the mating internally threaded surface of the upper extent 79 of the drag block sub 37.

A dove tail slip assembly designated generally as 81 is carried about the mandrel 29 on the packer body as shown in FIG. 2. The slip assembly 81 includes slips 83 which are mounted within a slip housing 85 which threadedly engages the upper end 86 of inner sleeve 69. Slips 83 are extendable radially outwardly to engage the well casing 13 upon downward movement of the mating slip expander 87. Slip expander 87 is moved downwardly by setting sleeve 89 which is connected at the lower end thereof to slip expander 87 by means of screws 91. The protruding ends 93 of screws 91 ride in slots which are provided in a setting sleeve mandrel 95 which is carried about the inner mandrel 29 and which has a lower end 94 which threadedly engages the internal threads of slip housing 85.

Setting sleeve 89 is connected by means of a threaded end 97 to a lower retaining ring 99 of the packer assembly 19. Ring 99 is retained on a shoulder 101 provided in the lower exterior of a generally cylindrical seal element mandrel 103. Screws 102 in the lower exterior of the seal element mandrel 103 are received within slots 139 in the setting sleeve 89. Deformable seal elements 21, 23, 25 are carried about the exterior of seal element mandrel 103 and are divided by seal spacers 105. As shown in FIG. 1, the externally threaded surface 107 of seal element mandrel 103 threadedly engages a mating internal surface 109 of a hold down head 111. An upper retaining ring 113 is received about the lower externally threaded surface 115 of head 111.

Hold down head 111 has a plurality of openings 117 provided therein for receiving a plurality of fluid actuated hold down buttons 119 which are retained within openings 117 by means of leaf springs 121 and screws 123. The upper portion 147 of hold down head 111 has an external shoulder 125 upon which is received a circumferential gage ring 127. The external surface of the hold down head 111 above gage ring 127 is threaded to engage the lower threaded interior portion 129 of packer body 15. The hold down head 111 internal diameter decreases from the upper portion 147 thereof to form an internal shoulder 131 which is adapted to contact an upset area 133 in the mandrel 29 when the mandrel moves downwardly with respect to the packer body 15.

As shown in FIGS. 1 and 2, the mandrel 29 is spaced-apart from the packer body 15, hold down head 111, and seal element mandrel 103 to thereby define a fluid flow path 135 between the exterior of the mandrel and the interior of the packer body 15. Passage means communicate the mandrel longitudinal passageway 35 with the fluid flow path 135. In the running-in position shown in FIGS. 1 and 2, fluid in the well annulus 137 (see FIG. 2) can flow through slots 139 in the exterior of the tool and into the opening 141 created between the internal diameter of the seal element mandrel 103 and the external diameter of the mandrel 29. As shown in FIG. 1, the fluid is free to flow through the lower passageway 143 created between the internal diameter of the hold down head 111 and the mandrel 29, and through the area 145 between the mandrel 29 and upper portion 147 of the hold down head 111.

Figure 3:
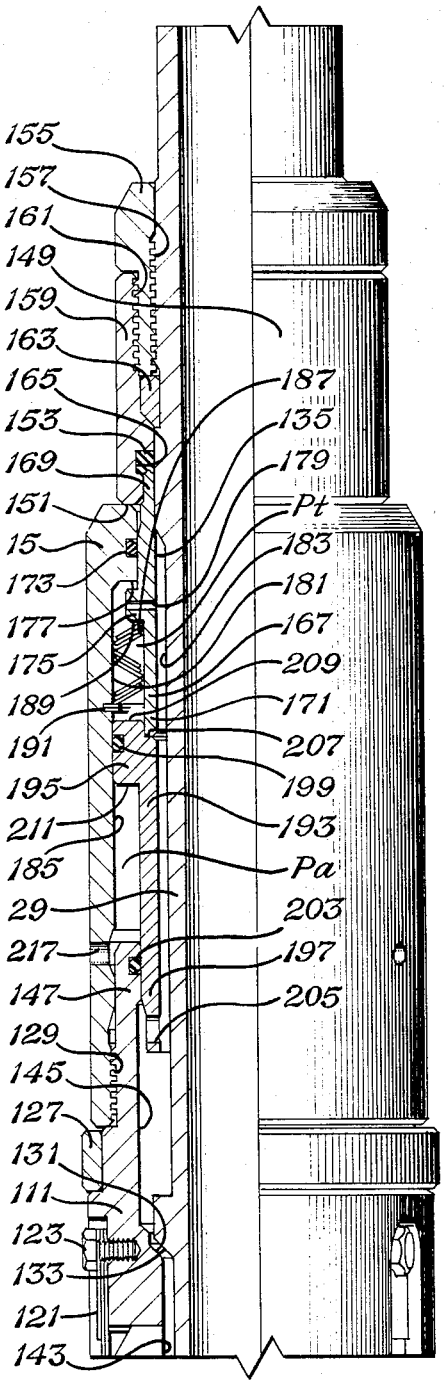
FIG. 3 is a side partial cross-sectional view of the packer of FIG. 1 showing the operation of the seal means when the well annulus pressure exceeds the pressure within the packer mandrel.
Figure 4:
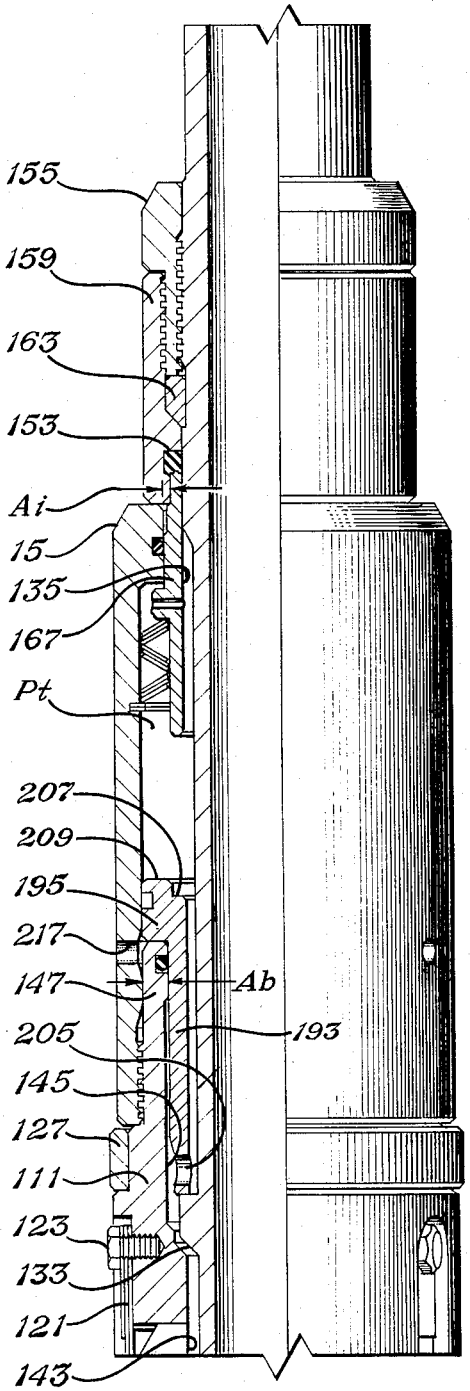
FIG. 4 is a side partial cross-sectional view similar to FIG. 3 showing the operation of the seal means when the pressure within the packer mandrel exceeds the well annulus pressure.

The upper end of the packer body 15 and the mandrel 29 are shown in greater detail in FIGS. 3 and 4. As shown in FIG. 3, the mandrel 29 includes a face seal housing 149 as a part of the mandrel 29. The face seal housing 149 includes a weight loading shoulder 151 and a deformable seal portion 153. The mandrel 29, as shown in FIGS. 1 and 3, is slidable between an open, running-in position (FIG. 1) in which the fluid flow path 135 communicates the annular space 27 above the packer assembly 19 with the mandrel longitudinal passageway 35 and a closed, set-position (FIG. 3) in which the fluid flow path 135 is sealed off. The weight loading shoulder 151 is engageable with the packer body 15 when the mandrel 29 is in the closed, set-position (FIG. 3) to thereby support the weight of the mandrel 29 from the body 15.

The face seal housing 49 forms an upset area in the external diameter of the mandrel 29. The upset area has an upper extent 155 formed by a threaded sub having an internally threaded surface 157 adapted to matingly engage an externally threaded portion of the mandrel exterior and a lower extent 159 having an internally threaded surface 161 which matingly engages the threaded lower exterior of the upper extent 155. A circumferential ring 163 is carried between the upper extent 155 and lower extent 159, as shown in FIG. 3. The lower extent 159 of the upset area forms a circumferential weight loading shoulder 151 which is engageable with the packer body and which includes a circumferential recess 165 containing the deformable seal portion 153.

Pressure biased seal means including seal compressor 167 are carried between the mandrel 29 and the packer body 15 for contacting the deformable seal portion 153 when the mandrel 29 is in the closed, set position to seal off the fluid flow path 135. The pressure biased seal compressor is a generally cylindrical member having an upper extent 169 for contacting the deformable seal portion 153 and having a lower extent 171. An O-ring 173 forms a seal between the packer body 15 and the exterior of the seal compressor upper extent 169. Seal compressor 167 also includes an upset area 175 in the approximate mid-region thereof which contacts an internal shoulder 177 of the packer body 15 to limit the upward travel of the seal compressor 167. The seal compressor 167 also has a series of ports 179 for communicating the fluid flow path 135 with an annular pressure chamber 181 formed in the packer body 15 between the mandrel exterior 183 and the packer body interior 185. As shown in FIG. 3, the packer body 15 has a region of lesser relative internal diameter forming internal shoulder 177 which joins the downwardly extending interior region 185 of greater relative internal diameter to thereby define the pressure chamber 181. Seal compressor 167 is biased in the direction of the deformable seal portion 153 as by springs 187 which are fitted between the rear face 189 of the upset area 175 and a spring stop 191 fitted in the wall of the pressure chamber 181.

A balancing piston 193 is received within the pressure chamber 181 below the seal compressor 167 which is engageable with the seal compressor to urge the seal compressor toward the deformable seal portion 153. The balancing piston 193 is a generally cylindrical member having an upper piston portion 195 of greater relative external diameter and a lower portion 197 of lesser relative external diameter. An O-ring 199 forms a seal between the piston portion 195 exterior and the interior of the pressure chamber 181. The lower portion 197 of the balancing piston slidingly contacts the upper portion 147 of the hold down head 111 where a fluid seal is formed by an O-ring 203 in upper portion 147. The lower portion 197 of piston 193 also includes a series of ports 205. The piston portion 195 includes an interior ledge 207 for receiving the lower extent 171 of seal compressor 167 for urging seal compressor 167 in the direction of the deformable seal portion 153.

Piston portion 195 has a primary face area 209 and a secondary face area 211. The primary face area 209 is acted upon by fluid pressure from within the mandrel longitudinal passageway 35 communicated through the open lower end 34 of the mandrel (FIG. 2), the well annulus 137 below the packer assembly 19, through slots 139 in the setting sleeve 89 into area 215, through the opening 141 between the seal element mandrel 103 and the mandrel 29, through the lower passageway 143 and area 145 adjacent hold down head 111, through ports 205 to the flow path 135, and through the ports 179 in seal compressor 167 (FIG. 3) into the annular pressure chamber 181. The balancing piston secondary face area 211 is acted upon by fluid pressure from the annular space 27 above the packer assembly 19 communicated to the secondary face area 211 through ports 217 in the packer body 15.

As seen in FIG. 3, the secondary face area 211 of the balancing piston 193 which is acted upon by the fluid pressure in the annular space 27 is of greater relative cross-sectional area than the cross-sectional area of the seal compressor upper extent 169 which is acted upon by fluid pressure in annular space 27 which acts through the point of contact between the weight loading shoulder 151 and the packer body 15. These areas are designated areas $A_b$ and $A_i$, respectively, in FIG. 4. Because of the area relationships, the balancing piston 193 contacts the seal compressor 167 to urge the seal compressor in the direction of deformable seal portion 153 when the annulus pressure in the annular space 27 acting on the piston secondary face area 211 exceeds the pressure acting on the primary face area 209.

The operation of the improved packer will now be described. In a typical packing operation, the packer body 15 would be lowered to the desired depth on a pipe string. Once the desired depth is reached, the mandrel 29 is rotated from the surface to release the control dog 57 from the threaded surface 53 of the mandrel allowing the mandrel to slide downwardly relative to the packer body 15. The weight of the pipe string acting through weight loading shoulder 151 causes setting sleeve 89 to move slip expander 87 under the slips 83 to force the slips radially outwardly into contact with the surrounding well conduit 13 to anchor the packer in position within the well bore. Once the slips 83 are set, downward movement of setting sleeve 89 is stopped causing the packer assembly seal elements 21, 23 and 25 to be deformed outwardly into sealing contact with the conduit 13 to pack off the well annulus 137 below the packer assembly 19.

As the packer assembly 19 is sealing off the well annulus, the weight loading shoulder 151 of face seal housing 149 is engaging the packer body 15 to support the weight of the pipe string on the packer body 15. As shown in FIG. 3, when shoulder 151 contacts the packer body 15 the seal compressor 167 contacts the deformable seal portion 153 to seal off the fluid flow path 135. The mandrel longitudinal passageway 35 can then be pressured up with fluid from the surface. Fluid flows through the longitudinal passageway 35 and out the open lower end 34 of the tool into the well annulus 137 below the packer assembly 19. Fluid in the well annulus below the packer assembly can move freely through slots 139 into the opening 141 and through the lower passageway 143 into the area behind the hold down buttons 119. Since the upper end of the fluid flow path 135 is sealed off by the contact between the seal compressor 167 and the deformable seal portion 153, the hold down buttons 119 are forced radially outwardly into contact with the surrounding well conduit 13 to further anchor the tool in place in the well bore. The seal between the seal compressor 167 and the seal portion 153 is maintained without loading the weight of the pipe string on the seal portion 153.

The seal compressor 167 also compensates for pressure differentials existing in the well bore to maintain sealing engagement with the seal portions 153. Assume first that the pressure in the annular space 27 ($P_a$) above the packer assembly 19 is greater than the fluid pressure in the mandrel longitudinal passageway 35 ($P_t$), i.e., $P_a$ is greater than $P_t$. The forces acting on the seal compressor 167 are then equal to $A_b - A_i$. Since $A_b$ is greater than $A_i$ the balancing piston 193 is biased in the upward direction and forces seal compressor 167 in the direction of the deformable portion 153.

If the pressure within the mandrel longitudinal passageway 35 is greater than the pressure in the annular space 27, $P_t$ is greater than $P_a$. The forces working on the seal compressor 167 are then equal to $A_i$ and the balancing piston 193 moves out of contact with the seal compressor 167, as shown in FIG. 4. The balancing piston 193 moves down to contact shoulder 210 on mandrel 29 to bias mandrel 29 downwardly thereby causing weight loading shoulder 151 to more tightly engage the upper end of packer body 15. The seal compressor 167 remains in sealing contact with the deformable seal portion 153. The seal compressor 167 is thus biased toward the deformable seal portion to close off the fluid flow path regardless of the direction of the pressure differential acting upon the tool.

The packer 11 can be retrived by an upward pull on the mandrel 29 which breaks the seal between seal compressor 167 and seal portion 153 thereby opening fluid flow path 135 and balancing the pressure differential across the packer assembly 19. Continued upward pull on the mandrel 29 first relaxes the packer assembly 19 which, in turn, allows release of the slip assembly 81 and allows the packer to be retrieved from the well bore.

An invention has been provided with significant advantages. The novel face seal housing and seal compressor arrangement of the tool allow the seal compressor to be pressure biased closed regardless of the direction of the pressure differential which exists in the well bore. The load carrying shoulder of the face seal housing supports large compressive loads which are often encountered in service work without increasing the compressive stress in the deformable seal portion of the tool. An upward pull on the pipe string breaks the seal between the face seal housing and packer body and equalizes the pressure differential across the packer assembly to aid in retrieval of the tool. The pressure biased seal compressor eliminates the need for individually adjusting a tool to meet the specific conditions present in the well bore being treated.

While the invention has been shown in only one of its forms, it is not thus limited but is susceptible to various changes and modifications without departing from the spirit thereof.

I claim:

1. An improved oil well packer, comprising:

a packer body having a longitudinal bore extending therethrough;

a packer carried on said packer body for sealing off the annular space between said body and a surrounding wall conduit;

a mandrel slidably disposed within said body longitudinal bore, said mandrel having upper connecting means for connecting said mandrel in a pipe string and having a longitudinal passageway extending therethrough for communicating with said pipe string;

sid mandrel being spaced-apart from said body to thereby define a fluid flow path between the exterior of said mandrel and the interior of said body;

passage means communicating said mandrel longitudinal passageway and said fluid flow path;

said mandrel being slidable between an open, running-in position in which said fluid flow path communicates the annular space above said packer with said mandrel longitudinal passageway and a closed, set-position in which said fluid flow path is sealed off;

a face seal housing as a part of said mandrel, said face seal housing forming an upset area in the external diameter of said mandrel, said upset area having an upper extent and a lower extent, the lower extent of said upset area forming a circumferential weight loading-shoulder engageable with said packer body and including a circumferential recess containing a deformable seal portion; and a pressure biased seal compressor carried between said mandrel and said body for contacting said deformable seal portion when said mandrel is in said closed, set-position to seal off said fluid flow path.

2. The oil well packer of claim 1, wherein said seal compressor is a generally cylindrical member having an upper extent for contacting said deformable seal portion and a lower extent.

3. The oil well packer of claim 2, further comprising an annular pressure chamber in said packer body between said mandrel exterior and said packer body interior, said seal compressor being received within an upper portion of said pressure chamber.

4. The oil well packer of claim 3, further comprising a balancing piston received within said pressure chamber below said seal compressor and engageable with said seal compressor to urge said seal compressor toward said deformable seal portion, said balancing piston having a primary face area and a secondary face area.

5. The oil well packer of claim 4, wherein said balancing piston primary face area is acted upon by fluid pressure from said mandrel longitudinal passageway communicated through said passage means and fluid flow path and wherein said balancing piston secondary face area is acted upon by fluid pressure from said annular space between said body and the surrounding well conduit communicated to said secondary face area through port means in said packer body.

6. The oil well packer of claim 5, wherein the secondary face area of said balancing piston which is acted upon by said annular fluid pressure is of greater relative cross-sectional area than the cross-sectional area of said seal compressor upper extent which is acted upon by said annular fluid pressure.

7. The oil well packer of claim 6, wherein said packer body has an internal shoulder of lesser relative internal diameter which joins a downwardly extending region of greater relative internal diameter defining said pressure chamber, said balancing piston being sized to be slidably received between said downwardly extending region and said mandrel exterior.

8. The oil well packer of claim 7, wherein said seal compressor has an upset area in the exterior thereof which contacts said packer body internal shoulder to thereby limit the upward travel of said seal compressor within said pressure chamber.

9. The oil well packer of claim 8, wherein the balancing piston contacts said seal compressor to urge said seal compressor in the direction of said deformable seal portion when said annular pressure acting on said piston secondary face area exceeds the pressure acting on said primary face area.

10. The oil well packer of claim 9, wherein said seal compressor is spring biased in the direction of said deformable seal portion.

11. A method of packing off an oil well bore, comprising the steps of:

suspending a packer body within said well bore, said body having a longitudinal bore extending therethrough;

providing a packer on said packer body for sealing off the annular space between the body and the surrounding well bore;

providing a mandrel slidably disposed within said body bore, said mandrel having upper connecting means for connecting said mandrel in a pipe string and having a longitudinal passageway extending therethrough for communicating with said pipe string, said mandrel being spaced-apart from said body to thereby define a fluid flow path between the exterior of said mandrel and the interior of said body, and said mandrel being slidable between an open running-in position in which said fluid flow path communicates with the annular space above the said packer and a closed, set-position in which said fluid flow path is sealed off;

providing passage means to communicate said mandrel longitudinal passageway and said fluid flow path;

providing a face seal housing as a part of said mandrel, said face seal housing having a weight loading shoulder and a deformable seal portion, said weight loading shoulder being engageable with said packer body;

providing a seal compressor carried between said mandrel and said body for contacting said deformable seal portion when said mandrel is in said closed, set-position to seal off said fluid flow path;

rotating said pipe string from the surface;

lowering said pipe string, and in turn said mandrel, with respect to said packer body to move said weight loading shoulder into contact with said packer body; and pressure biasing said seal compressor into contact with said deformable seal portion to seal off said fluid flow path.

* * * * *